US007384227B2

(12) United States Patent
Rieck et al.

(10) Patent No.: US 7,384,227 B2
(45) **Date of Patent: *Jun. 10, 2008**

(54) METHOD FOR FIXING THE POSITION OF A PULL-TAB WITH A STEEP ANTI ROTATION DEVICE FORMED FROM THE PANEL OF A SHEET METAL COVER

(75) Inventors: Hajo Rieck, Grafschaft (DE); Martin Gray, Flintshire (GB); Richard Chalk, Flintshire (GB)

(73) Assignee: Ball Packaging Europe GmbH, Ratingen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/541,846

(22) PCT Filed: Dec. 23, 2003

(86) PCT No.: PCT/DE03/04282

§ 371 (c)(1),
(2), (4) Date: May 15, 2006

(87) PCT Pub. No.: WO2004/065033

PCT Pub. Date: Aug. 5, 2004

(65) Prior Publication Data

US 2006/0277966 A1 Dec. 14, 2006

(30) Foreign Application Priority Data

Jan. 13, 2003 (DE) ..... 103 00 914
May 5, 2003 (DE) ..... 103 19 971
May 21, 2003 (DE) ..... 103 25 561

(51) Int. Cl.
*B21D 51/44* (2006.01)

(52) U.S. Cl. ..... 413/12; 413/17

(58) Field of Classification Search ..... 220/270, 220/906, 269; 413/8, 12, 14–17, 66, 67, 413/55; 72/379.4
See application file for complete search history.

(56) References Cited

U.S. PATENT DOCUMENTS 3,191,564 A 6/1965 Fraze (Continued)

FOREIGN PATENT DOCUMENTS

DE 7018731 U 8/1970

(Continued)

OTHER PUBLICATIONS

Patent Abstracts of Japan of JP 09226762, published Sep. 2, 1997.

(Continued)

*Primary Examiner*—Derris H. Banks
*Assistant Examiner*—Debra M Wolfe
(74) *Attorney, Agent, or Firm*—Greenblum & Bernstein, P.L.C.

(57) ABSTRACT

The invention relates to a method for forming a sheet metal lid. At least one projection is formed twice. First, the projection is shaped from a panel of the sheet metal lid, the pre-form being located near an attaching portion of a tab, but at a distance from the mounting place. Second, at least a front edge of the pre-form of the at least one projection is re-formed. No score line is provided in the panel, neither during shaping, nor during re-forming. An improved blocking for an outer edge portion of the attaching portion is thus obtained, the outer edge portion being associated with the front edge.

8 Claims, 3 Drawing Sheets

U.S. PATENT DOCUMENTS

| | | | | |
|---|---|---|---|---|
| 3,749,275 | A | 7/1973 | Smith, Jr. et al. | |
| 3,780,902 | A | 12/1973 | Hole et al. | |
| 3,782,586 | A | 1/1974 | Brown | |
| 3,785,522 | A | 1/1974 | Prayer et al. | |
| 3,812,803 | A * | 5/1974 | Brown | 413/8 |
| 3,868,918 | A | 3/1975 | Smith, Jr. et al. | |
| 3,871,314 | A * | 3/1975 | Stargell | 413/13 |
| 3,967,754 | A | 7/1976 | Ostrem | |
| 4,416,389 | A | 11/1983 | Wilkinson et al. | |
| 4,455,114 | A | 6/1984 | Zysset | |
| 4,535,909 | A | 8/1985 | Zysset | |
| 4,596,342 | A | 6/1986 | Zysset | |
| 4,826,037 | A | 5/1989 | La Croce | |
| 5,129,541 | A | 7/1992 | Voigt et al. | |
| 5,494,184 | A | 2/1996 | Noguchi et al. | |
| 5,799,816 | A | 9/1998 | Schubert | |
| 5,918,499 | A | 7/1999 | Langlasse et al. | |
| 2006/0016815 | A1 | 1/2006 | Rieck et al. | |
| 2007/0062950 | A1 | 3/2007 | Rieck et al. | |

FOREIGN PATENT DOCUMENTS

| | | |
|---|---|---|
| DE | 2 008 138 | 9/1971 |
| DE | 21 00 580 | 10/1971 |
| DE | 7127606 U | 10/1971 |
| DE | 2 024 535 | 12/1971 |
| DE | 7212780 U | 8/1972 |
| DE | 2 256 498 | 11/1972 |
| DE | 7227762 U | 11/1972 |
| DE | 22 60 375 | 6/1974 |
| JP | 8 053 131 | 2/1996 |
| JP | 9 226 762 | 9/1997 |

OTHER PUBLICATIONS

Container Manufacturing Standard EO-27, 63mm DIA EO. 27 END, one page, document date Mar. 10, 1983, no known publication date.

Container Manufacturing Standard EO-38, 209 DIA E.O. 38 END, one page, document date Jul. 9, 1981, no known publication date.

Container Manufacturing Standard EO-41, 50mm DIA EO41 END, one page, document date Mar. 18, 1987, no known publication date.

* cited by examiner

METHOD FOR FIXING THE POSITION OF A PULL-TAB WITH A STEEP ANTI ROTATION DEVICE FORMED FROM THE PANEL OF A SHEET METAL COVER

CROSS-REFERENCE TO RELATED APPLICATIONS

The invention relates to a further improvement or further provision of a positional fixing of a tab on a sheet metal lid according to the simultaneously filed (co-pending) PCT application No. PCT/DE2002/004283, originating from the same inventors and the same legal successors, the disclosure of said application being incorporated by reference herein. The corresponding U.S. application is Ser. No. 10/541,845, published as US 2007/0062950.

BACKGROUND OF THE INVENTION

1. Field of the Invention

The invention relates to a method of shaping a portion of a sheet metal lid of a beverage can, the lid including a panel having an openable area defined by a score line in the panel, and a mounting place for attaching a tab for breaking into the openable area.

2. Description of Background and Relevant Information

When the tab is in an attached condition to the sheet metal lid, it is known by the expect as a SOT (Stay on Tab), which is provided for opening an openable area in the surface of a lid (usually designated as a "panel"). For this purpose, the tab is taken at a grip end and raised with a vertical tilting motion for breaking open an openable area along a line of weakness (usually called a "score line") with its opening end.

Particularly when large opening ends (LOE) are used for the openable area, difficulties are encountered in the related art to when fixing the positions of the tab in an attached condition to the sheet metal lid. Suggestions on this topic have already been made, for example, in U.S. Pat. No. 5,799,816 (Schubert). In this document, an opening of an attaching portion of the tab is proposed, which attaching portion is usually designated as a "rivet island". The attaching portion is secured to the panel of the sheet metal lid through a shaped rivet and overlaps a round to elongated reformed bead with an opening provided in the attaching portion. The bead may also be formed after attaching the tab, compare column 3, lines 63-67, column 5, lines 37-44, claim 3 of Schubert and the associated graphical illustration in FIGS. 2 and 4 thereof.

SUMMARY OF THE INVENTION

The invention addresses the technical problem of achieving the aforementioned effect, but with an improved manufacture and reliability of the anti-rotation block and with an improved positional alignment of the tab in the attached condition. For this purpose, a method is proposed.

Advantageously, an already present peripheral edge on a usual tab is used, the edge not having to be specifically formed additionally for obtaining the rotation barrier after the attachment of the tab to the panel (commonly referred to as "staking"). The only manipulation is effected on the sheet metal lid itself, which is provided with a shape or molding, as the rivet is in a preliminary phase, which shape or molding may preferably also be pre-formed in parallel together with the formation of the rivet and subsequently be modified in shape, or more precisely "reformed", in a further processing step of the sheet metal lid being manufactured. The projection can thus be formed integrally with the sheet metal lid, as is the securing point is formed by one-piece manufacturing for the attaching portion of the tab.

The projection does not protrude through an opening of the attaching portion, and the attaching portion is not provided with an opening beforehand, but the attaching portion remains entire and a blocking means that acts on the attaching portion from an outside is provided, as disclosed in the aforementioned PCT application and the aforementioned US 2007/0062950.

Forming at least one projection to have an asymmetrical cross section is particularly advantageous, such projection having a steeper side facing the attaching portion than the side facing away from the attaching portion. Such a shape may also be selected for punctiform or oval projections.

In a subsequent reshaping, reforming, or post-forming, the thickness of a top side of the (strip-shaped) projection is reduced. Thereby, a solidification of the portion and the projection as a whole is achieved. This also applies to the method. The score line can be introduced not simultaneously with the reforming, in temporally shifted or offset processing steps. The same is valid for the pre-forming of the bead, which is not shaped at the same time, as the score line is introduced.

In order to obtain the blocking effect, which can also be a limiting effect, which is to be understood to range from a complete prevention of a rotating movement up to a substantial limitation of the rotating movement, an outer edge of the flat attaching portion (i.e., the rivet island) is stopped by abutting against the projection that is shaped to protrude out of the sheet metal lid.

The projection can have a strip shape (i.e., a line shape) and be preferably oriented one of transversely and in parallel to a longitudinal extension of the tab (longitudinal axis or longitudinal plane), the projection engaging at a correspondingly oriented peripheral edge of the attaching portion for its blocking effect or being provided very closely adjacent thereto. In a longitudinal extension, the projection can extend over more than 30%, preferably over more than 50% to more than 80% of the width of the attaching portion.

Several projections can be provided, not all projections having to be associated with the same outer edge portion of the attaching portion. The projections can also be differently shaped, i.e., strip-shaped, round to oval, or a combination thereof. If a straight-lined outer edge portion of the attaching portion is provided, a straight-lined (strip-shaped) embodiment of the projections can be advantageous. The straight-lined or linear strip embodiment can also be achieved by arranging at least two punctiform projections in a line, which then form a group that is associated with the same outer edge portion of the attaching portion.

When several projections are provided in the aforementioned sense, they do not have to engage the same edge line of the attaching portion when starting a rotating movement, but instead they can be assigned to different outer edges.

When providing a strip-shaped projection, it can be designed to have a length longer than the diameter of the finished rivet head.

The attaching portion being formed from a piece of the central portion of the tab, only minor gaps are visible between the attaching portion, which is displaced downwards to a lower plane by a double buckling line, and the somewhat higher, parallel plane of the remaining tab. Accordingly, the mounting of the projections on at least one of the free peripheral edges facing outward from the attaching portion is barely or only hardly visible from the outside, so that the rotation blocking is virtually invisible to the observer. A colored tab is not changed further in its colored appearance.

BRIEF DESCRIPTION OF THE DRAWINGS

Exemplary embodiments explain and supplement the following detailed description of the invention, wherein further reference is made to the content of the disclosure of the aforementioned PCT application and US publication. The invention is further described in the detailed description, in which like reference numerals represent similar parts throughout the views of the drawings, and wherein.

DETAILED DESCRIPTION OF THE INVENTION

Figure 1:
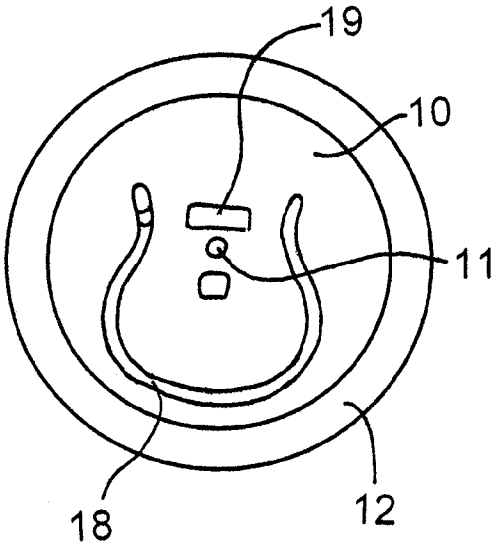
FIGS. 1, 2, and 3 show three stages in a manufacturing process of a sheet metal lid, comprising a station for inserting a score line or a weakening line 16, a station for introducing a finger depression 13 and additional beads 18*a* in the openable area inside the score/weakening line, and a first station at which a pre-form 19 of a bead 20 is shaped, achieving a blockage of the rotational behavior of a tab 30.
Figure 2:
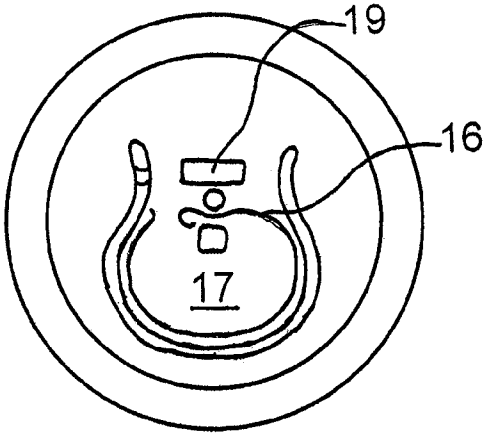
Figure 3:
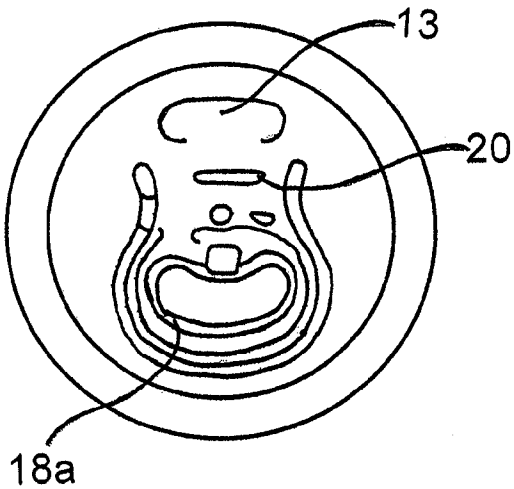

The sheet metal lid obtained according to a method as shown in FIGS. 1 to 3 has a visible edge portion 12 as a seamable edge that is suitable for seaming to a body of a beverage can. The sheet metal lid itself is produced from thin sheet metal, typically less than 0.24 mm, and has already passed through preceding workstations before reaching the stage shown in FIG. 1. The lid comprises an inner surface portion (panel) 10 surrounded by a seamable edge 12. Within the panel 10, a weakening line 16 is to be introduced around an openable area, the openable area being surrounded by a substantially U-shaped bead 18. Within the bead, which opens in the center portion of the panel, a substantially oval weakening line 16 is to be designed as a score line having a transitional section that is not scored and thus serves as a connecting portion to the rest of panel 10 when the openable area 17 is broken in along the score line 16 by the effect of a tab, which is explained below. This is illustrated in FIG. 2.

Figure 4:
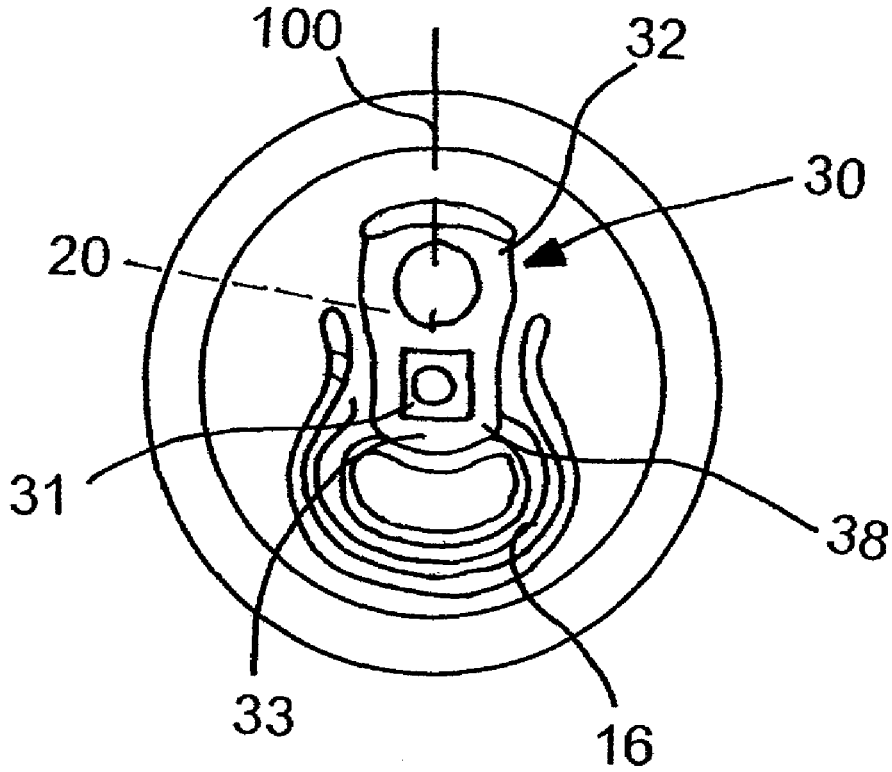
FIGS. 4 and 5 show a further, subsequent manufacturing station, at which a tab 30 is mounted over a rivet 11 integrally formed on the sheet metal lid, via an attaching portion 31, which as a flat attachment tongue (rivet island) serves for mounting ("staking")
Figure 5:
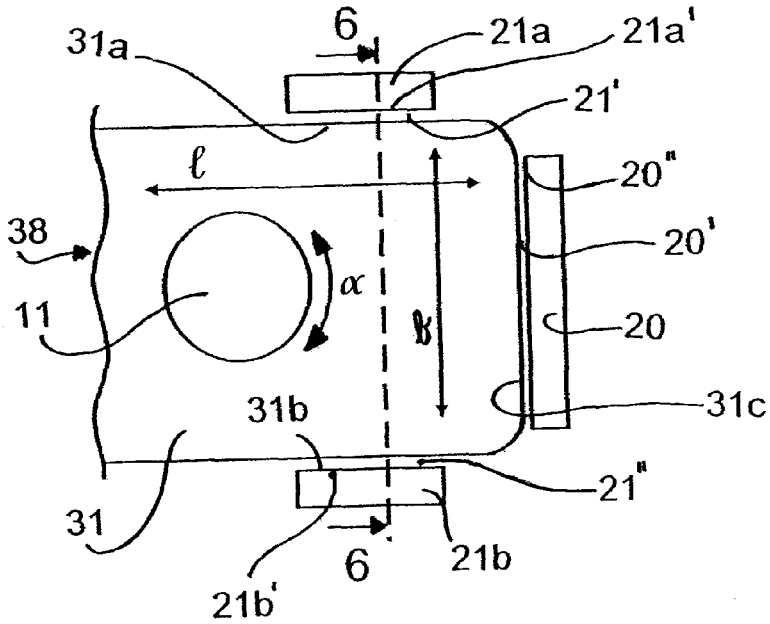

FIG. 5 shows a mounting place 11 provided approximately in the middle of the panel 10. An attaching portion 31 as a sheet metal tongue is schematically associated therewith, the attaching portion 31 being part of the tab according to FIG. 4, on which it is formed integrally via an articulation line as a buckling line 38. The tab 30 comprises a grip portion 32, provided here with a circular opening, at which the tab is operated by the user for breaking open the score line 16 according to FIG. 2. The tab 30 also comprises an opening nose portion 33 before the attaching portion 31, the opening portion being located as a break-in nose above the openable area 17, for which purpose an additional, eyeball-shaped bead 18*a* as shown in FIG. 3 is provided in a separate working step, the bead reinforcing the transverse LOE openable area, for being able to apply the opening forces to the break-open starting portion (loop-shaped end of the score line 16). The mounted tab 30 is substantially parallel to the panel 10, which itself does not have to be designed exactly in one plane, but may be slightly bulged, though the area around the mounting place 11 is substantially planar, or flat, allowing a substantially parallel arrangement of the attaching tongue 31 of the tab 30.

Figure 6:
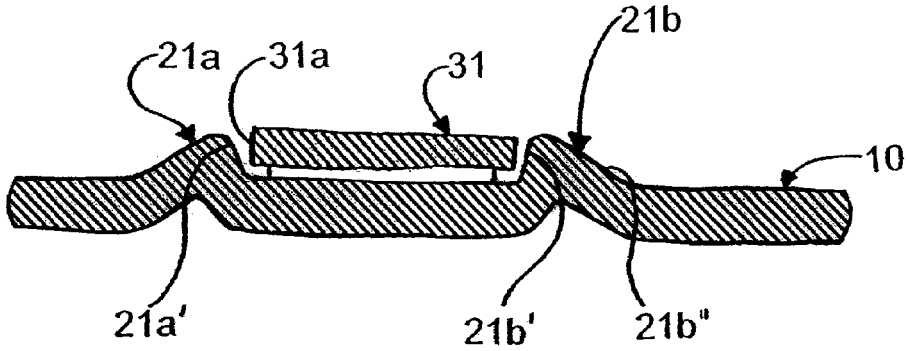
FIG. 6 is a sectional view, taken along line 6-6 of FIG. 5.

As shown in the figures, at least one of the three strip-shaped projections 20, 21*a*, 21*b* (see FIGS. 5, 6) is re-formed around the area for the mounting place 11 as upwardly protruding beads (i.e., towards the outside of the sheet metal lid). The bead 20, extending transversely to a midplane 100, is longer than the two neighboring beads 21*a*, 21*b*, which extend parallel to the midplane 100.

At one manufacturing station, the re-forming of the three beads 20 (or also 21*a*, 21*b*) is improved or designed more exactly. The "re-forming" results in a formation of the beads (projections) as used later for the positional fixing, according to FIG. 3 and as shown in various ones of the drawing figures of the aforementioned US 2007/0062950. At the station, the at least one projection receives its correct profile geometry, after having been re-formed integrally from the sheet metal lid (the panel) according to FIG. 1. As mentioned in the Summary above, forming at least one projection to have an asymmetrical cross section is particularly advantageous, such projection having a steeper side 21*a* ' and 21*b* ' facing the attaching portion 31 than the side (such as 21*b*") facing away from the attaching portion. Such a shape may also be selected for punctiform or oval projections.

As more particularly described in the aforementioned US 2007/0062950, reference being made below to drawings and reference numerals thereof, a re-forming step comprises a shaping of the pre-form 19 with a coining operation (i.e., an embossing operation) for further flattening the top surface 20*c*. In the re-forming process, the tool is applied likewise from the top and from the bottom for the re-forming. The slight bend according to FIG. 8*a* of the aforementioned US 2007/0062950 that is detectable on the left in the rising side of the pre-form 19 can be recognized in the final form illustrated in FIG. 8*a* of the aforementioned US 2007/0062950, the way in which the sharp front edge 20" is introduced in the initially gently rising left incline of the shaped pre-form 19 also being visible. To the right of the transverse plane 101, the second incline of the pre-form is shaped from bottom to top, for forming a flat top side 20*c* starting approximately at the instep of the pre-form 19, the top side, in a portion 20*b*, leading gently over to the rest of the sheet metal panel 10.

Additionally, in the final form, the attaching portion 31, which is mounted at the rivet 11, and also the tab 30 are already attached according to FIG. 4, also in a sectional view. The tab is arranged with its intermediate web between the left opening and the grip opening 32*b*, substantially above the transversely extending projection 20. The two openings of the tab are shown in FIG. 4, one opening resulting from the formation of the attaching portion 31, which is further connected to the tab 30 via an articulation line 38, whereas the opening for inserting a finger is designed particularly. The opening 32*b* forms part of the grip portion 32, the web 32*a* between the two openings being shown slightly bulged in FIG. 8*a* of the aforementioned US 2007/0062950, having a front edge 32*c* that was related to the free edge 31*c* of the attaching portion 31 during manufacture. A major part of the projection 20 is thus located below the web and is barely visible from outside.

In this context, a modified sequence of the two-stage re-forming can be performed besides the processing sequence according to FIGS. 1 to 3 herein or in the aforementioned US 2007/0062950, for example an initial introduction of the at least one pre-form, as illustrated by the pre-form 19 in the top picture of FIG. 8*a* of US 2007/

0062950, in a first working step, still without the introduction of score lines (as weakening lines), of which weakening line 16 is an example. For a projection 20 with a related pre-form 19, this is illustrated by the sequence of FIGS. 1, 2, and 3; the subsequent assembly can be identical to that illustrated in FIG. 4.

If multiple projections are used for blocking rotating movements of the tab—all pre-forms 19 are shaped according to FIG. 1. In the figure, only one projection is illustrated. The first score line is introduced only later, in a separate working step, e.g., after re-forming (further shaping) of the pre-shaped projection 19. Here, the one projection receives its correct, assigned profile, as is shown in the bottom illustration of FIG. 8*a* of US 2007/0062950. In this way, it can be realized that a scoring operation, subjecting the sheet metal to severe stresses, is not performed at the same time as the shaping of the pre-form takes place in the first working step, the shaping considerably stressing the sheet metal lid. The score line can be introduced prior to or after the re-forming operation which also stresses the sheet metal. During re-forming—as shown in FIG. 8*a*—the wall thickness on the top side of the projection is reduced by about 10% to 15%, with a simultaneously occurring compression and solidification of the portion, which is achieved by the embossing operation (coining) uniformly from the top and from the bottom.

The invention claimed is:

1. A method for shaping a portion of a sheet metal lid for a beverage can, the lid comprising a panel having an openable area defined by a score line in said panel, and a mounting place for attaching a tab for breaking in said openable area, said method comprising:

(i) forming at least one projection in said panel at least twice by (a) shaping a pre-form of the at least one projection, from a portion of the panel, the pre-form placed at a distance from and opposite said mounting place for being suitably positioned to cooperate with an attaching portion of the tab when attached to said mounting place;

(b) re-forming at least a front portion of said pre-form to increase an angle of inclination of this front portion with respect to a remainder of the panel, to give the projection an asymmetrical cross-section and, during said re-forming, a top portion of the pre-form is flattened and stiffened;

(ii) during said shaping and during said re-forming, no score line is created in said panel.

2. A method according to claim 1, further comprising:

introducing or inserting a score line into said panel after said shaping the pre-form of the at least one projection.

3. A method according to claim 1, wherein:

said re-forming comprises an embossing for flattening and stiffening the top portion of said projection.

4. A method according to claim 1, wherein:

said stiffening provides a reduction of a sheet metal thickness of said pre-form.

5. A method according to claim 1, wherein:

said score line is formed into said panel after said re-forming of said pre-form.

6. A method according to claim 1, wherein:

said score line is formed into said panel after shaping said pre-form from said portion of the panel, and prior to said re-forming of said pre-form.

7. A method according to claim 1, wherein:

said re-forming and said shaping are done at one forming station.

8. A method for shaping a portion of a sheet metal lid for a beverage can, the lid comprising a panel having an openable area defined by a score line in said panel, and a mounting place for attaching a tab for breaking in said openable area, said method comprising forming at least one projection in said panel by (a) shaping a pre-form of the at least one projection from a portion of the panel, the pre-form placed at a distance from and opposite said mounting place for being suitably positioned to cooperate with an attaching portion of the tab when attached to said mounting place;

(b) re-forming at least a front portion of said pre-form to increase an angle of inclination of said front portion with respect to a remainder of the panel, to give the projection an asymmetrical cross-section and, during said re-forming, a top portion of the pre-form is flattened and stiffened.

* * * * *